United States Patent [19]

Pinkston et al.

[11] Patent Number: 4,932,324

[45] Date of Patent: Jun. 12, 1990

[54] MOUNTING DEVICE FOR ADHESIVE-BACKED BLANKETS

[75] Inventors: Melvin D. Pinkston, Waynesville, N.C.; Kenneth A. Hines, Dayton, Ohio

[73] Assignee: Day International Corporation, Dayton, Ohio

[21] Appl. No.: 202,936

[22] Filed: Jun. 6, 1988

[51] Int. Cl.[5] ..... B41F 27/00

[52] U.S. Cl. ..... 101/486; 33/618; 101/415.1

[58] Field of Search ..... 101/415.1, 378, 382.1, 101/383, 483, 485, 486; 33/618, 619, 623

[56] References Cited

U.S. PATENT DOCUMENTS

| | | | |
|---|---|---|---|
| 3,281,946 | 11/1966 | Walsh | 33/618 |
| 3,390,633 | 7/1968 | Boughton | 33/618 X |
| 4,467,722 | 8/1984 | Klingelhoefer et al. | 101/415.1 X |

FOREIGN PATENT DOCUMENTS

| | | | |
|---|---|---|---|
| 520253 | 6/1953 | Belgium | 101/415.1 |

*Primary Examiner*—Edgar S. Burr
*Assistant Examiner*—Moshe I. Cohen
*Attorney, Agent, or Firm*—Killworth, Gottman, Hagan & Schaeff

[57] ABSTRACT

A device and method for installing an adhesive-backed printing blanket on a cylinder is provided. The printing blanket has an adhesive backing for holding it on the cylinder and a leading edge substantially perpendicular to the edge of the blanket. The device comprises an angle bar having a generally orthogonal pair of leg forming an inside corner therebetween for receiving the leading edge of the printing blanket to be contiguous therewith. A first one of the legs has an inside surface being an adherend of limited adhesion, the periphery of the adhesive backing adjacent the leading edge being removably adherable thereto. The first leg also has an outside surface formed to be axially aligning with the cylinder when placed thereon. As a result, the leading edge of the printing blanket is held squarely in place on the angle bar while the printing blanket is wrapped evenly around the cylinder.

21 Claims, 3 Drawing Sheets

MOUNTING DEVICE FOR ADHESIVE-BACKED BLANKETS

BACKGROUND OF THE INVENTION

The present invention relates to the installation of an adhesive-backed printing blanket on a cylinder and, more particularly, a device and method for positioning the printing blanket on the cylinder so that it is wrapped evenly on the cylinder.

A printing blanket comprises an outer layer, formed mainly of a polymeric material, and a backing material on one side of the outer layer. The other side of the outer layer is the printing surface which carries ink for printing. The blanket is wrapped on a cylinder to transfer an inked image from a printing plate to paper during the printing process. To achieve high quality printing, the blanket must not slip or creep on the cylinder. One method of securing the blanket to the cylinder has been to lock the leading and trailing edges of the blanket in a spring-loaded mechanism housed in a gap or groove extending axially along the surface of the cylinder. Unfortunately, unsecured portions of the blanket may continue to slip and the locking mechanisms make installation and removal of the blanket cumbersome.

Another method of securing the blanket to the cylinder which has been used is to coat the back or nonprinting side of the printing blanket with a high tack adhesive. This method of installation of the blanket is less complicated and reduces blanket-creep on the cylinder by securing all portions of the blanket to the cylinder with adhesive. Such adhesive-backed blankets comprise a printing blanket having a pressure-sensitive adhesive coating on the backing material for securing the blanket to the cylinder and a release film, such as polyethylene, covering the adhesive coating. The release film serves as a protective covering to preserve the adhesive coating before the blanket is installed on the cylinder.

The blanket is installed on the cylinder by peeling back the protective covering about one inch from the leading edge across the entire width of the blanket and attaching the leading edge to the cylinder so that it is properly aligned with the edge of the gap and the side edges of the cylinder. Once the leading edge of the blanket is properly positioned on the cylinder, the cylinder is rotated slowly and the protective covering is removed as the cylinder rotates. As a result, the remaining portion of the blanket is attached and stuck to the cylinder as the cylinder rotates.

Although the adhesive-backed blanket simplified installation, it created a new set of problems related to the proper alignment of the adhesive-backed blanket on the cylinder. More specifically, it is difficult to axially align the leading edge of the blanket with the edge of the gap and the side edge of the cylinder. If the leading edge is not properly aligned, a wrinkle can form in the blanket or a pocket of air may be trapped resulting in a bubble as it is wrapped around the rotating cylinder. In any event, an improperly installed adhesive-backed blanket must be removed and properly reinstalled. Removal of the blanket, however, reduces the adhesiveness of the backing which negates one of the benefits of using the adhesive-backed blanket, i.e., reducing blanket-creep on the cylinder. Additionally, even though installation may be simplified, it is still cumbersome and time consuming.

Accordingly, there is a need for a device and method for facilitating the proper axial alignment of the leading edge of an adhesive-backed printing blanket on a cylinder and for holding the leading edge of the blanket in place to achieve the necessary dimensional stability for wrapping the blanket evenly around the cylinder.

SUMMARY OF THE INVENTION

The present invention meets this need by providing a device for installing a printing blanket on a cylinder. The printing blanket has an adhesive backing for holding it on the cylinder and a leading edge substantially perpendicular to the edges of the blanket. The device comprises an angle bar having a generally orthogonal pair of legs forming an inside corner therebetween for receiving the leading edge of the printing blanket to be contiguous therewith. A first one of the legs has an inside surface being an adherend of limited adhesion, the periphery of the adhesive backing adjacent the leading edge being removably adherable thereto, and an outside surface formed to be axially aligned with the cylinder when placed thereon. As a result, the leading edge of the printing blanket is held squarely in place on the angle bar while the printing blanket is wrapped evenly around the cylinder.

In one embodiment of the invention, the outside surface (i.e., the side contacting the cylinder) of the first leg is concave. However, when the cylinder has a gap extending axially along the surface thereof, the outside surface of the first leg comprises means, extending generally perpendicular therefrom and axially aligned with said angle bar, for engaging the gap of the cylinder. Thus, in another embodiment of the invention, the engaging means is positioned adjacent the outside corner formed by the orthogonal pair of legs so that the leading edge of the printing blanket is alignable with the edge of the gap in the cylinder. In yet another embodiment of the invention, the engaging means is positioned at a desired distance from the outside corner formed by the orthogonal pair of legs so that the leading edge of the printing blanket is alignable with the edge of the gap in the cylinder and extendable by the desired distance therein.

The present invention further meets these needs by providing a method for installing a printing blanket on a cylinder. The method comprises the steps of positioning the leading edge of the printing blanket contiguous with the inside corner of an angle bar, one of the legs of the angle bar having an inside surface of limited adhesion and an outside surface axially aligned with the cylinder when placed thereon, and then pressing the periphery of the adhesive backing adjacent the leading edge against the inside surface of the leg so that it removably adheres thereto. The method further comprises the step of positioning the outside surface of the leg on the cylinder so that the angle bar is axially aligned therewith. As a result, the leading edge of the printing blanket is held squarely in place on the angle bar while the printing blanket is wrapped evenly around the cylinder. If, however, the cylinder has a gap extending axially along the surface thereof, the method may further comprise the step of positioning the outside corner of the angle bar at a desired distance into the gap so that the leading edge of the printing blanket is alignable with the edge of the gap and extendable by the desired distance therein.

In another embodiment of the invention, the method comprises the steps of inserting the leading edge of the printing blanket into the inside corner of an angle bar so that the printing blanket adheres to the inside thereof, aligning the angle bar axially on the cylinder, wrapping the remaining portion of the printing blanket around the cylinder, peeling the leading edge of the printing blanket off the angle bar and removing the angle bar from the cylinder, and flattening the peeled leading edge of the printing blanket on the cylinder. If, however the cylinder has a gap extending axially along the surface thereof, the method may further comprise the step of aligning the outside corner of the angle bar at a desired distance from the edge of the gap.

Accordingly, it is an object of the present invention to provide a device and method for axially aligning the leading edge of an adhesive-backed blanket on a cylinder having a gap; to provide a device and method for positioning the leading edge of the blanket a fixed distance from the edges of the gap and the side edge of the cylinder; and, to provide a device and method for holding the leading edge in place to achieve the necessary dimensional stability for wrapping the blanket evenly around the cylinder. Other objects and advantages of the invention will be apparent from the following description, the accompanying drawings, and the appended claims.

DETAILED DESCRIPTION OF THE PREFERRED EMBODIMENTS

Figure 1:
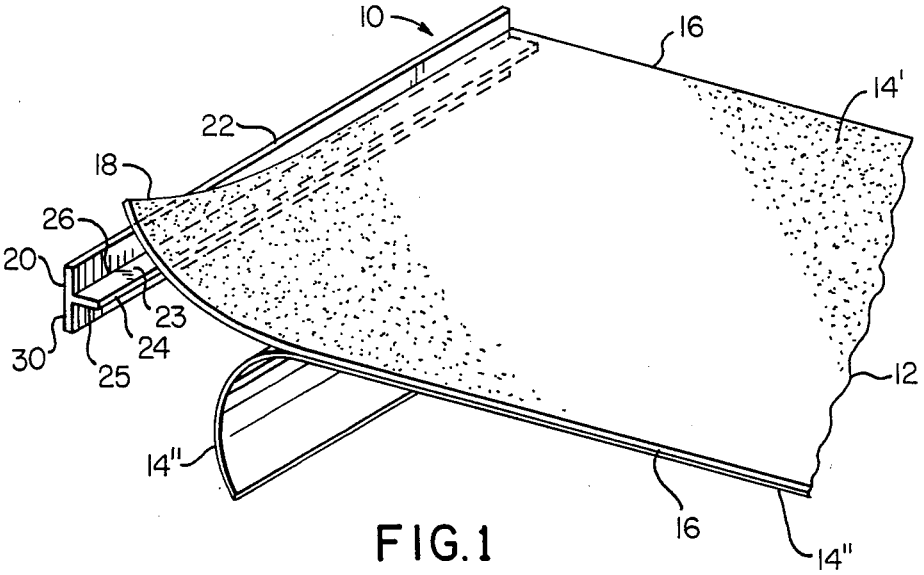
FIG. 1 is a perspective view of a first embodiment of a device for installing an adhesive-backed printing blanket in accordance with the invention.

FIG. 1 shows an alignment device 10 which is useful for installing an adhesive-backed printing blanket 12 on a cylinder. Adhesive-backed printing blanket 12 comprises a printing blanket 14' having a pressure-sensitive adhesive coating or backing (not shown) on one side for holding the blanket on the cylinder and a release film 14'', such as polyethylene, covering the adhesive coating. Release film 14'' serves as a protective covering to preserve the adhesive coating before the blanket 12 is installed on the cylinder. Such adhesive-backed printing blankets are commercially available from the assignee of the present invention under the name "THE DAY INTERNATIONAL STICKY-BAK" Blanket. Blanket 12 is available in a variety of gauges ranging from 0.034 to 0.039 inch and widths ranging from 6 to 50 inches depending on the length of the cylinder. The length of the blanket depends on the diameter of the cylinder. Blanket 12 has substantially parallel sides 16 and a leading edge 18 cut to be substantially perpendicular to sides 16.

Alignment device 10 comprises an angle bar 20 having a generally orthogonal pair of legs 22 and 24 forming an inside corner 26 for receiving leading edge 18 of printing blanket 12 so that it is contiguous therewith. Essentially, the leading edge 18 is inserted into inside corner 26 so that it butts against leg 22 which serves as a stop to align leading edge 18 squarely on angle bar 20. It is to be understood that the present invention is not limited to the structure of stop leg 22 of an angle bar, but may be any means for stopping leading edge 18 so that it is aligned squarely on leg 24. Such stopping means may be, for example, a plurality of flanges or tabs, a rod, or other mechanism.

Leg 24 serves as a contact leg having an inside surface 23 which is an adherend for the periphery of the adhesive backing adjacent leading edge 18 of blanket 12. Inside surface 23 is an adherend of limited adhesion, i.e., it is sufficiently adhesive to hold blanket 12 in place so that the leading edge 18 remains butted against stop leg 22 when blanket 12 is pulled, yet sufficiently nonadhesive so that it does not diminish significantly the adhesiveness of the adhesive backing when leading edge 18 is removed therefrom. Thus, contact leg 24 can be, for example, a metal such as aluminium, plastic, or any "TEFLON"-coated or plated material to ensure that the inside surface 23 is an adherend of limited adhesion. In the preferred embodiment, the width of contact leg 24 should be at least about one-half inch to provide a sufficiently large contact surface between inside surface 23 and blanket 12 to hold it in place.

Contact leg 24 also has an outside surface 25 formed to be axially aligned with the cylinder when placed thereon. Outside surface 25 is so formed by means, extending generally perpendicular from outside surface 22 and axially aligned with angle bar 20, for engaging a groove in the cylinder. In a first embodiment of the present invention, such engaging means is preferrably an insert bar 30. It is to be understood that the present invention is not limited to the structure of insert bar 30, but may be any engaging means such as, for example, a plurality of tabs axially aligned with angle bar 20. Furthermore, the engaging means is generally perpendicular only to the extent necessary to engage the groove in the cylinder.

Figure 2:
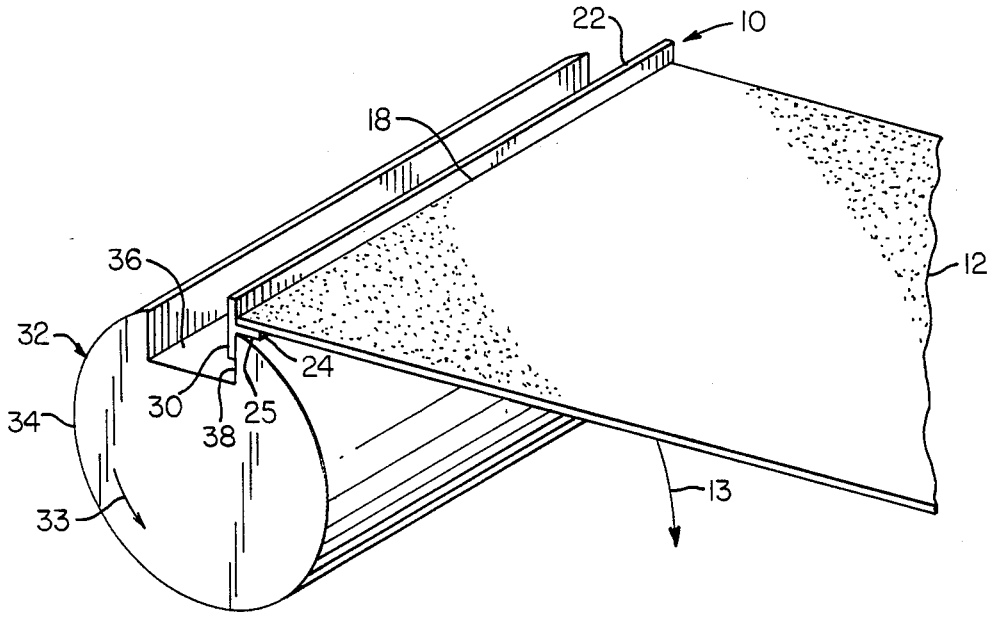
FIG. 2 is a perspective view showing the device of FIG. 1 positioned on a cylinder.

Referring more specifically to FIG. 2, alignment device 10 is used for installing printing blanket 12 on a cylinder 32 having a surface 34 and a gap or groove 36 extending axially along surface 34 thereof. Gap 36 has an edge 38 which is engaged by the insert bar 30. As described above, insert bar 30 extends generally perpendicular from outside surface 25 of contact leg 24 to the extent necessary to engage edge 38 of gap 36 which holds aligning device 10 squarely in place on cylinder 32. Furthermore, insert bar 30 is positioned so that leading edge 18 of printing blanket 12 is aligned with edge 38 of the gap 36 in cylinder 32.

Figure 3:
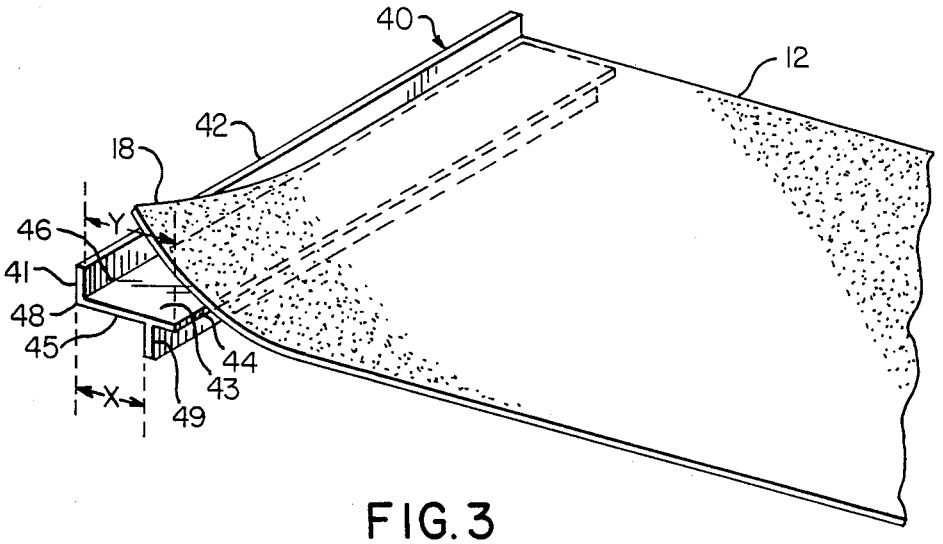
FIG. 3 is a perspective view of a second embodiment of a device for installing an adhesive-backed printing blanket in accordance with the invention.
Figure 4:
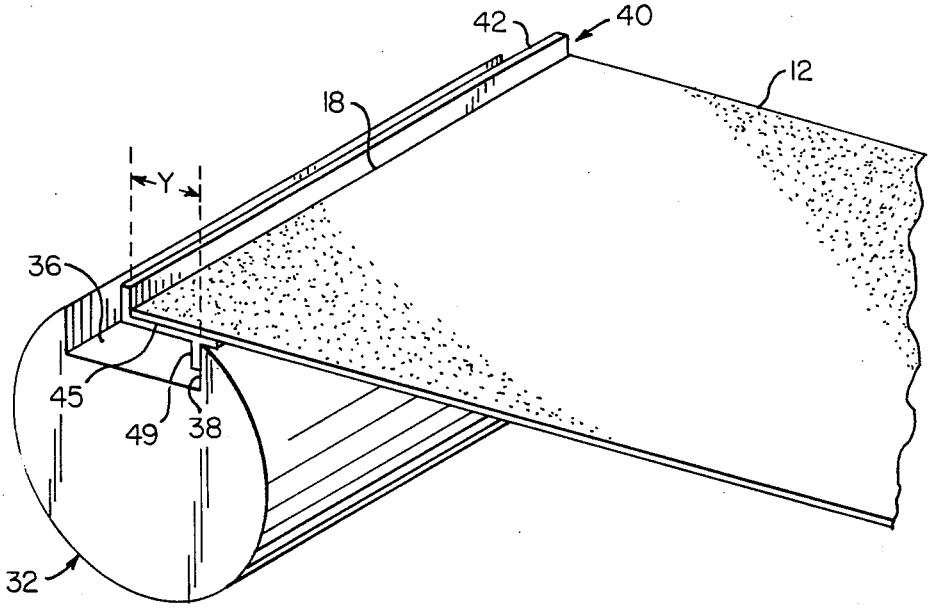
FIG. 4 is a perspective view showing the device of FIG. 3 positioned on a cylinder.

In a second embodiment of the present invention, an alignment-device 40 shown in FIGS. 3 and 4 is substantially similar to alignment device 10, except that the engaging means is positioned in a different location. Alignment device 40 comprises an angle bar 41 having a generally orthogonal pair of legs 42 and 44 forming an outside corner 48 and an inside corner 46 for receiving leading edge 18 of printing blanket 12. Contact leg 44 has an inside surface 43 and an outside surface 45. An insert bar 49 extends generally perpendicular from outside surface 45 and is positioned a desired distance, X, from outside corner 48 of angle bar 41, so that leading edge 18 of blanket 12 aligns with edge 38 of gap 36 and extends by a distance, Y, therein, as shown in FIG. 4. The distance, Y, is about equal to the desired distance, X. Thus, insert bar 49 extends generally perpendicular from the outside surface 45 of the contact leg 44 to the extent that it is sufficiently perpendicular to engage edge 38 of gap 36 which holds alignment device 40 squarely in place on cylinder 32. Furthermore, insert bar 49 is positioned the desired distance, X, from outside corner 48 so that leading edge 18 of blanket 12 extends by the distance, Y, into gap 36 of cylinder 32.

Figure 5:
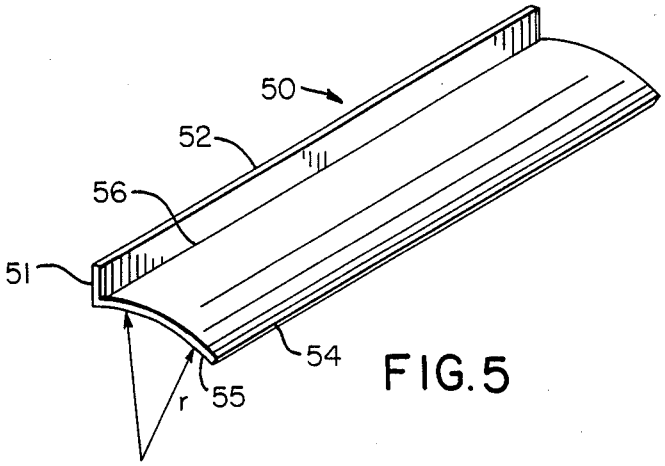
FIG. 5 is a perspective view of a third embodiment of a device for installing an adhesive-backed printing blanket in accordance with the invention.

In some printing machines cylinder 32 does not have a gap. A third embodiment of the present invention, an alignment device 50 shown in FIG. 5, is designed for use on such a "gapless" cylinder, but can also be used on a cylinder with a gap such as cylinder 32. Alignment device 50 is substantially similar to alignment device 10 except that it does not include means for engaging the gap in the cylinder. Alignment device 50 comprises angle rod 51 having a generally orthogonal pair of legs, a stop leg 52 and a contact leg 54, forming an inside corner 56. Legs 52 and 54 are sufficiently orthogonal so that leading edge 18 of blanket 12 may be positioned contiguous with inside corner 56 and aligned squarely against stop leg 52.

Contact leg 54 has an outside surface 55 formed to be axially aligned with the cylinder 32 when placed thereon. The entire contact leg 54 is rounded to an inside radius, r, which is equal to or less than the outside radius of cylinder 32, so that outside surface 55 is concave. Even if the radius of the outside surface 55 is less than the radius of cylinder 32, alignment device 50 will still axially align itself with cylinder 32 when placed thereon because the opposite ends of contact leg 54 will each engage the cylinder surface and act as a self-squaring mechanism for the device.

Figure 6:
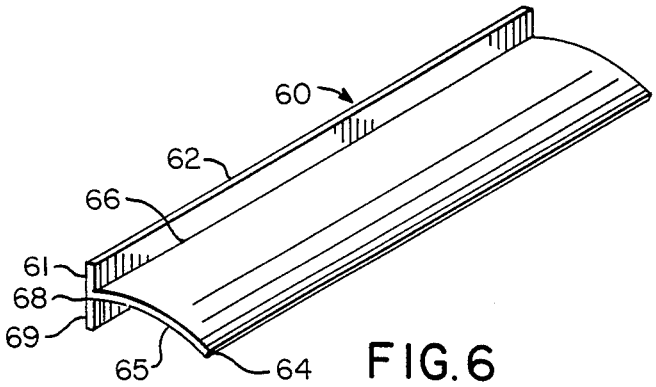
FIG. 6 is a perspective view of a fourth embodiment of a device for installing an adhesive-backed printing blanket in accordance with the invention; and, FIG. 7 is a perspective view of a fifth embodiment of a device for installing an adhesive-backed printing blanket in accordance with the invention.
Figure 7:
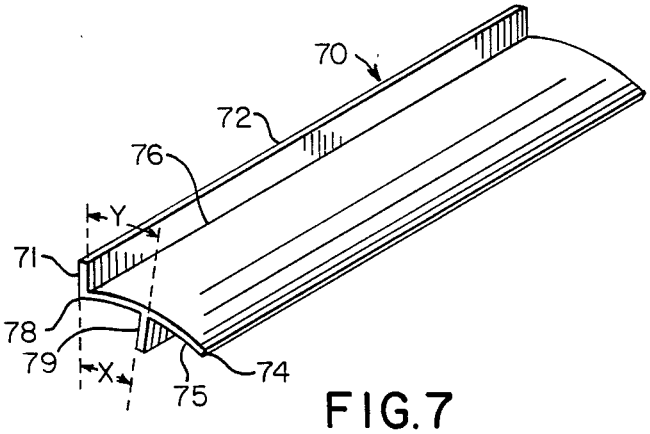

Modified versions of the embodiments illustrated in FIGS. 1 and 3 are shown in FIGS. 6 and 7. Alignment devices 60 and 70 are substantially the same as the alignment device 50, except for a single modification which includes means for engaging the gap in a cylinder. Alignment device 60 comprises an angle bar 61 having a generally orthogonal pair of legs 62 and 64 forming an outside corner 68 and an inside corner 66 for receiving leading edge 18 of printing blanket 12. Contact leg 64 has an outside surface 65 that is concave. Alignment device 60 further comprises an insert bar 69 extending generally perpendicular from outside surface 65 of contact leg 64 and axially aligned with angle bar 61 for engaging edge 38 of gap 36. Furthermore, insert bar 69 is positioned adjacent outside corner 68 of angle bar 61 so that leading edge 18 of printing blanket 12 is aligned with edge 38 of gap 36 of cylinder 32.

Alignment device 70 comprises an angle bar 71 having a generally orthogonal pair of legs 72 and 74 forming an outside corner 78 and an inside corner 76 for receiving leading edge 18 of printing blanket 12. Contact leg 74 has an outside surface 75 that is concave. Alignment device 70 further comprises an insert bar 79 extending generally perpendicular from outside surface 75 of contact leg 74 and axially aligned with angle bar 71 for engaging edge 38 of gap 36. Additionally, insert bar 79 is positioned the desired distance, X, from outside corner 78 of angle bar 71 so that leading edge 18 of printing blanket 12 is aligned with edge 38 of gap 36 and extends the distance, Y, therein.

All of the alignment devices 10, 40, 50, 60 and 70 operate in essentially the same manner. Leading edge 18 of printing blanket 12 is inserted into the inside corner of the angle bar so that the printing blanket adheres therein and, more specifically, so that leading edge 18 of printing blanket 12 is contiguous with the inside corner of the angle bar. The periphery of the adhesive backing adjacent leading edge 18 is then pressed against the inside surface of the contact leg so that it removably adheres thereto.

The angle bar is then aligned axially on the cylinder by positioning the outside surface of the contact leg on the cylinder so that the insert bar, if there is one, engages edge 38 of gap 36 in cylinder 32. Alignment device 50 is simply positioned on cylinder 32 without the use of an insert bar. Once the angle bar is axially aligned on cylinder 32, the remaining portion of printing blanket 12 is wrapped around cylinder 32 in a direction indicated by arrow 13 while cylinder 34 rotates in a direction indicated by arrow 33 as shown in FIG. 2. The protective covering 14" is removed as cylinder 32 rotates as shown in FIG. 1.

After printing blanket 12 has been wrapped evenly around cylinder 32, leading edge 18 of printing blanket 12 is peeled off the inside surface of the contact leg of the angle bar. The aligning device is then removed from cylinder 32. The peeled portion leading edge 18 is then flattened on cylinder 32 so that it adheres thereto. As a result, the alignment devices provide the necessary dimensional stability for wrapping adhesive-backed printing blanket 12 evenly around cylinder 32.

Having described the invention in detail and by reference to preferred embodiments thereof, it will be apparent that other modifications and variations are possible without departing from the scope of the invention defined in the appended claims.

What is claimed is:

1. A device for installing a printing blanket on a cylinder, the printing blanket having an adhesive backing for holding it on the cylinder and a leading edge substantially perpendicular to the edges thereof, said device comprising:

an angle bar having a generally orthogonal pair of legs forming an inside corner therebetween for receiving the leading edge of the printing blanket to be contiguous with said inside corner, a first one of said legs having an inside surface being an adhered of limited adhesion which is sufficiently non-adhesive so that it does not diminish significantly the adhesiveness of the adhesive backing when the leading edge is removed therefrom, the periphery of the adhesive backing adjacent the leading edge being removably adherable thereto, and an outside surface formed to be axially aligned with the cylinder when placed thereon;

whereby, the leading edge of the printing blanket is held squarely in place on said angle bar while the printing blanket is wrapped evenly around the cylinder.

2. The device as recited in claim 1, wherein the length of said angle bar is substantially equal to the width of the printing blanket.

3. The device as recited in claim 1, wherein the width of said first leg is at least about one-half inch.

4. The device as recited in claim 1, wherein said first leg is aluminum.

5. The device as recited in claim 1, wherein said first leg is plastic.

6. The device as recited in claim 1, wherein said inside surface of limited adhesion is formed of a material of limited adhesion coated onto said first leg.

7. The device as recited in claim 1, wherein said outside surface of said first leg is concave.

8. The device as recited in claim 7, wherein the radius of said concave outside surface of said first leg is equal to or less than the radius of said cylinder.

9. The device as recited in claim 1, wherein the cylinder has a gap extending axially along the surface thereof and wherein said outside surface of said first leg comprises means, extending generally perpendicular therefrom and axially aligned with said angle bar, for engaging the gap in of the cylinder.

10. The device as recited in claim 9, wherein said engaging means is a bar.

11. The device as recited in claim 9, wherein said engaging means is positioned adjacent the outside corner formed by said pair of legs, so that the leading edge of the printing blanket is alignable with the edge of the gap in the cylinder.

12. The device as recited in claim 9, wherein said engaging means is positioned a desired distance from the outside corner formed by said pair of legs, so that the leading edge of the printing blanket is alignable with the edge of the gap in the cylinder and extendable by the desired distance therein.

13. A device for installing an adhesive-backed printing blanket on a cylinder, the printing blanket having a leading edge substantially perpendicular to the edges thereof, said device comprising:

an angle bar having an inside corner for receiving contiguously the leading edge of the printing blanket on said inside corner, one leg of said angle bar having an inside surface being an adherend of limited adhesion which is sufficiently nonadhesive so that it does not diminish significantly the adhesiveness of the adhesive backing when the leading edge is removed therefrom for attaching to the adhesive-backed portion of the printing blanket and a concave outside surface for axially aligning the angle bar with the cylinder when placed thereon;

whereby, the leading edge of the printing blanket is held squarely in place on said angle bar while the printing blanket is wrapped evenly around the cylinder.

14. The device as recited in claim 13 wherein the radius of said concave outside surface of said leg is equal to or less than the radius of said cylinder.

15. A device for installing an adhesive-backed printing blanket on a cylinder having a gap extending axially along the surface thereof, the printing blanket having a leading edge substantially perpendicular to the edges thereof, said device comprising:

an angle bar having an inside corner for receiving contiguously the leading edge of the printing blanket on said inside corner, one leg of said angle bar having an inside surface being an adherend of limited adhesion which is sufficiently nonadhesive so that it does not diminish significantly the adhesiveness of the adhesive backing when the leading edge is removed therefrom for attaching to the adhesive-backed portion of the printing blanket; and, means, extending generally perpendicular from the outside surface of said leg and axially aligned with said angle bar, for engaging the gap of the cylinder so that the angle bar is axially aligned with the cylinder when placed thereon;

whereby, the leading edge of the printing blanket is held squarely in place on said angle bar while the printing blanket is wrapped evenly around the cylinder.

16. The device as recited in claim 15, wherein the outside surface of said leg is concave.

17. A method for installing a printing blanket on a cylinder, the printing blanket having an adhesive backing for holding it on the cylinder and a leading edge substantially perpendicular to the edges thereof, comprising the steps of:

providing an angle bar having an inside corner and one leg with said one leg having an inside surface of limited adhesion which is sufficiently nonadhesive so that it does not diminish significantly the adhesiveness of the adhesive backing when the leading edge is removed therefrom;

positioning the leading edge of the printing blanket contiguous with the inside corner of said angle bar, said one leg of the angle bar having an outside surface axially aligned with the cylinder when placed thereon;

pressing the periphery of the adhesive backing adjacent the leading edge against the inside surface of the leg so that it removably adheres thereto;

positioning the outside surface of the leg on the cylinder so that the angle bar is axially aligned therewith; whereby the leading edge of the printing blanket is held squarely in place on the angle bar; and, wrapping the printing blanket evenly around the cylinder.

18. The method as recited in claim 17, wherein the cylinder has a gap extending axially along the surface thereof and further comprising the step of positioning the outside corner of the angle bar at a desired distance into the gap so that the leading edge of the printing blanket is alignable with the edge of the gap and extendable by the desired distance therein.

19. The method as recited in claim 17, further comprising the steps of: peeling the leading edge of the printing blanket off the angle bar and removing the angle bar from the cylinder, and wrapping the peeled leading edge of the printing blanket on the cylinder.

20. A method for installing an adhesive-backed printing blanket on a cylinder, the printing blanket having a leading edge substantially perpendicular to the edges thereof, comprising the steps of:

providing an angle bar having an inside corner and one leg with said one leg having an inside surface of limited adhesion which is sufficiently nonadhesive so that it does not diminish significantly the adhesiveness of the adhesive backing when the leading edge is removed therefrom;

inserting the leading edge of the printing blanket into the inside corner of said angle bar so that the printing blanket adheres to the inside thereof;

aligning the angle bar axially on the cylinder;

wrapping the remaining portion of the printing blanket around the cylinder;

peeling the leading edge of the printing blanket off the angle bar and removing the angle bar from the cylinder; and flattening the peeled leading edge of the printing blanket on the cylinder.

21. A method as recited in claim 20, wherein the cylinder has a gap extending axially along the surface thereof and further comprising the step of aligning the outside corner of the angle bar at a desired distance from the edge of the gap.

* * * * *